United States Patent [19]

Waddington

[11] 4,384,665

[45] May 24, 1983

[54] ULTRASONIC SENSING AND CONTROL APPARATUS

[75] Inventor: John E. Waddington, Warwick, R.I.

[73] Assignee: Waddington Electric, Inc., Cranston, R.I.

[21] Appl. No.: 260,039

[22] Filed: May 4, 1981

[51] Int. Cl.[3] ..... B65H 23/22; B65H 59/00

[52] U.S. Cl. ..... 226/42; 242/75.51

[58] Field of Search ..... 242/75.51, 182; 226/42, 226/19, 1, 30, 25, 113; 318/6, 7, 8; 72/17, 29, 10, 227; 340/1, 1 R

[56] References Cited

U.S. PATENT DOCUMENTS

| | | | |
|---|---|---|---|
| 2,147,467 | 2/1939 | Stephenson | 226/42 |
| 2,472,863 | 6/1949 | Socke | 164/89 |
| 2,888,259 | 5/1959 | Taylor | 226/42 |
| 2,907,565 | 10/1959 | Sauter | 226/42 |
| 3,047,198 | 7/1962 | Long | 226/42 |
| 3,108,032 | 5/1960 | Carlson | 156/361 |
| 3,156,397 | 11/1964 | Davies | 226/42 |
| 3,223,964 | 12/1965 | Stadlin | 340/1 |
| 3,225,988 | 12/1965 | Drenning | 226/19 |
| 3,240,411 | 3/1966 | Zarleng | 226/45 X |
| 3,342,284 | 1/1966 | Baird | 181/5 |
| 3,550,828 | 12/1970 | Watson | 226/30 |
| 3,637,123 | 1/1972 | Jones, Jr. | 226/42 |
| 3,721,376 | 3/1973 | Christian et al. | 226/42 |
| 3,771,114 | 11/1973 | Buchan et al. | 340/1 R |
| 3,811,304 | 5/1974 | Gorker | 72/17 |
| 3,890,547 | 6/1975 | Kock | 226/42 |
| 4,057,185 | 11/1977 | Slama et al. | 226/1 |
| 4,200,378 | 4/1980 | Shenk | 354/195 |

OTHER PUBLICATIONS

"Ultrasonic Ranging System", (Undated) by Polaroid Corporation.

*Primary Examiner*—Edward J. McCarthy

*Attorney, Agent, or Firm*—Hamilton, Brook, Smith and Reynolds

[57] ABSTRACT

A stock loop controller is disclosed which measures the round trip time of an ultrasonic signal transmitted to the stock loop and its return echo to generate a digital signal proportional to such time. The digital signal is converted to an analog signal and compared with a voltage reference across an amplifier. The resultant difference signal is used to control a motor operating the stock loop "take-up" or "feed-out" mechanism.

10 Claims, 4 Drawing Figures

ULTRASONIC SENSING AND CONTROL APPARATUS

DESCRIPTION

Technical Field

This invention is in the field of sonic sensing and control, and more specifically, relates to the control of slack formed in the feed of strips of material as the material is advanced to or between machines.

Background Art

In the processing of strips of material, such as metal strip stock, it is necessary to maintain a certain amount of slack in the material in order to have a continuous process. This slack takes the form of a loop in the path of the material. For proper operation of the associated machinery, it is important that this loop be maintained at a constant predetermined length.

The prior art is replete with apparatus devised for maintaining such loops at a constant length. The art may be classified in general as either "contact" or "non-contact" type devices. The contact loop control devices depend on some type of mechanical engagement with the feed material. The most commonly used "contact" loop control device comprises a pivotal mechanical element or arm having a roller at its distal end for engaging the looped portion of the material. As the loop size varies, the arm pivots activating limit switches which control the speed of the feed material to increase or decrease loop size. (See, for example, U.S. Pat. No. 3,811,304 to Gorker).

All contact type devices suffer from the same deficiency. Continuous contact with the feed material abrades the material and results in damage of the feed material.

For this reason, numerous non-contacting loop control devices have been devised. Many of these rely on photodectors which when interrupted or activated by changes in loop size from a predetermined value energize mechanisms for controlling the speed of the feed mechanism. (See, for example, U.S. Pat. No. 3,721,376 to Christian et al. and U.S. Pat. No. 3,637,123 to Jones Jr.) In order to maintain a relatively continuous measurement of loop distance, an overly expensive large array of photodetectors is required. Also, photodetector devices require a separate transmitter and detector mechanism.

Another alternative loop control system proposed in U.S. Pat. No. 3,156,397 to Davies relies on change in capacitance to create a control signal when a loop of conductive material passes a capacitive sensor. While this alternative avoids the wear involved in contact-type devices, it is only useful for material which affects capacitance. Thus, it will not sense variations in the loop distance of dielectric material, such as paper or cloth.

Disclosure of the Invention

In the apparatus of the present invention, a plurality of ultrasonic signals at different frequencies are transmitted in a short burst of energy from a transducer located adjacent the loop. Echo signals returning from the loop are sensed and the round trip distance is measured in a digital timing circuit. The timing circuit includes a clock which generates a fixed, precise number of pulses in a given time interval. This clock runs continuously but the pulses are only counted commencing with the leading edge of the transmitted ultrasonic signal and the count is stopped upon receipt of the echo signal. The number of clock pulses generated in this time interval represents the round trip distance from the transducer to a predetermined point on the loop, such as the apex. These clock pulses are loaded into a binary counter which counts the pulses and generates a digital signal proportional to the count; this digital signal is momentarily stored in a data latch circuit and then read into a digital-to-analog converter wherein the digital distance measurement is converted to an analog signal. This analog signal is coupled across an amplifier. The difference between the analog signal and a reference signal is amplified by the amplifier and coupled to an appropriate motor drive circuit to drive the motor controlling the loop feed system.

The gain of the amplifier may be adjusted by a potentiometer setting. In this manner, the sensitivity of the control may be adjusted to give either a very tight response or a loose response. An additional potentiometer is provided in series with the reference signal. This enables the output signal to be set at zero when the loop is correctly positioned.

The apparatus of the invention thus described allows for positioning of almost any type of material at a preset distance from the transducer. The fact that the transducer emits a plurality of different frequency signals contributes to this versatility. The strength of the return (echo signal) from close objects is highly dependent on the frequency of the ultrasonic frequency transmitted. Also, some materials absorb signals at one frequency but not at another. The availability of a transmitted signal of many different frequencies increases the probability that a strong echo signal will be returned.

The system may be used in pay-off and take-up feed roll systems for metallic, non-metallic, dielectric or non-dielectric feed material.

The apparatus of the invention preferably utilizes an "off-the-shelf" ultrasonic transmitter/receiver unit to supply the transmitted signal and echo signal. This unit is manufactured by the Polaroid Corporation and is sold for experimental purposes as the "Polaroid Ultrasonic Ranging Unit". The unit was originally employed as a camera lens focusing device and, as such, is described in U.S. Pat. No. 4,199,246 to Muggli.

BEST MODE OF CARRYING OUT THE INVENTION

Figure 1:
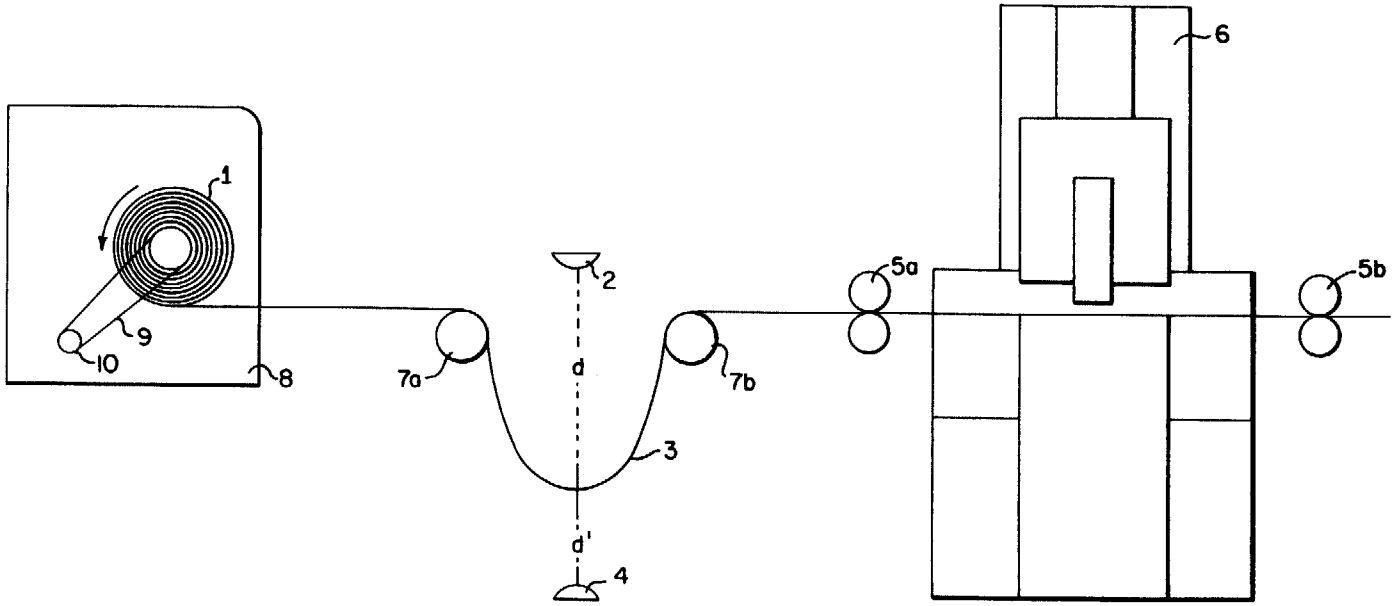
FIG. 1 is a schematic of the ultrasonic sensing and control apparatus of the invention as it would be utilized in an application for controlling roll stock.

FIG. 1 shows a typical application of the invention. In FIG. 1 roll stock 1 which may be dielectric or non-dielectric or metallic or non-metallic, is disposed on a spool driven by motor and motor drive apparatus 10 by means of a belt 9. The roll stock is passed over a first stock guide *7a* and a second stock guide *7b*. Between stock guide *7a* and *7b* a loop of roll stock is formed to permit a certain amount of slack in the feed. This stock loop 3 allows the stock to be fed in a continuous manner without undue tension occurring in the feed. The roll stock passes through a first pair of pinch rollers 5*a* and then to a customer's machine 6 and lastly, to a second pair of pinch rollers 5*b*. The customer's machine may be any of a variety of apparatus for processing the roll stock. A typical application would be a punch press.

It is of great importance that the depth of the stock loop 3 be maintained at a reasonably constant distance. In accordance with the present invention, a transducer 2 may be located as shown a distance d from the apex of the loop 3. As will be subsequently described, this transducer transmits an ultrasonic pulse along the path shown as D. After the pulse is transmitted the transducer senses any return echo signal, which is then coupled to the apparatus of the invention, and a signal generated which is used to control motor 10 to maintain the distance d substantially constant. Alternatively, the transducer may be located below the stock loop 3 as shown by the transducer 4 in order to measure the distance d' and hold this distance at a constant value.

Figure 2:
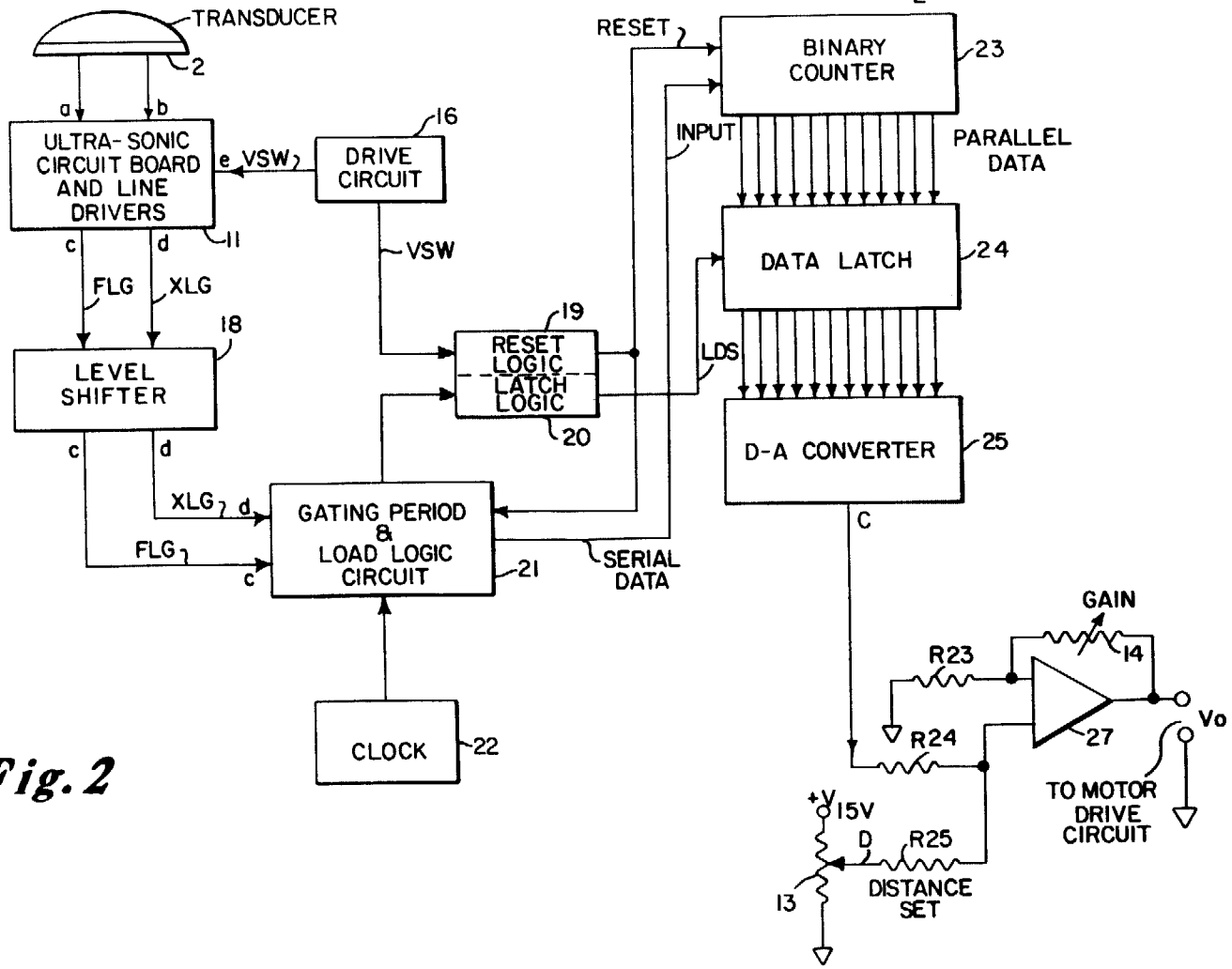
FIG. 2 is a block diagram of the ultrasonic sensing and control apparatus of the invention.
Figure 3:
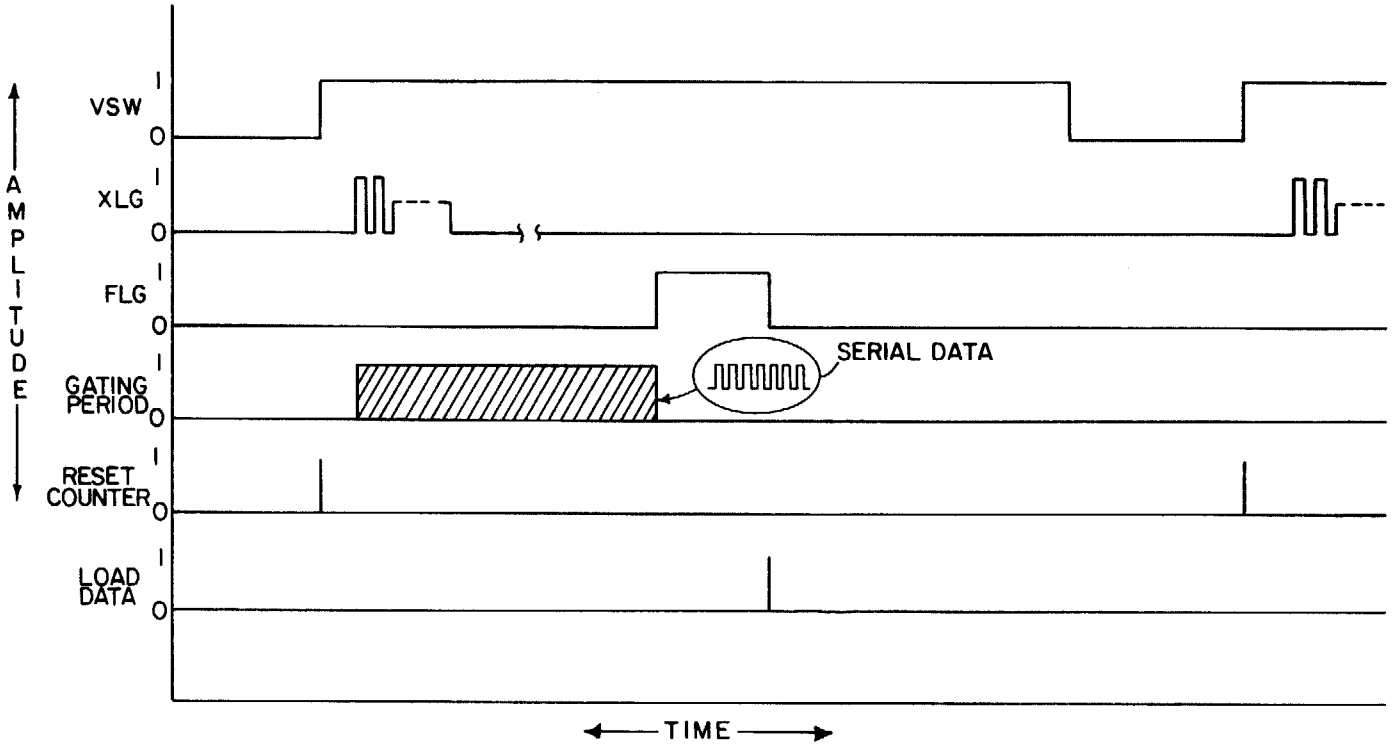
FIG. 3 is a waveform diagram showing the signals generated at various points within the apparatus of FIG. 2.

Having thus far described the setting for the apparatus of the present invention in connection with FIG. 1, we will now turn to FIG. 2 which is an overall block diagram of the invention and describe FIG. 2 along with FIG. 3 which shows the voltage waveform at various points in the circuit of FIG. 2.

The ultrasonic circuit board included in the block labelled 11 in FIG. 2 and the transducer 2 of FIG. 2 are substantially as described in connection with FIG. 3 of U.S. Pat. No. 4,199,246 dated Apr. 22, 1980 and incorporated herein by reference. The transducer 2 is an electrostatic transducer element. This transducer element is driven by a control voltage generator in the ultrasonic circuit board 11. This control voltage generator causes the transducer 2 to transmit a burst of ultrasonic energy in response to a keying pulse applied to the control voltage generator. The drive signal, which triggers the transducer is called the XLG signal. It consists of 8 cycles at 57 kHz, 16 cycles at 53 kHz, and 24 cycles at 50 kHz for a total of 56 cycles.

The transmitted pulse or burst of energy commences a short time after a VSW signal is turned on. This VSW signal is shown in FIG. 3 along with the XLG signal, the leading edge of which occurs a short time after the VSW signal. The time at which the leading edge of the XLG signal occurs is not predictable or repeatable from pulse to pulse, so the VSW signal is used to initiate the timing for the reset counter signal, also shown in FIG. 3, as will be explained. However, the leading edge of the XLG signal produces a signal for the gating period signal shown in FIG. 3 which will also be described in more detail later.

After the transducer signal is transmitted, a blanking gate, within the ultrasonic circuit board 11, produces a voltage that is applied to the output of a receiver to enable the output approximately 0.4 msec following the termination of the transducer transmitted energy burst and then maintains the output in active operation for a predetermined period of time which defines the receiver ranging time. This ranging time is preferably about 40 msec in duration. In this interval of time, sound at sea level at 20° C. travels from the transducer to a target located at about 7.3 m and returns to the transducer. The 0.4 msec delay in enabling the receiver output provides sufficient time for the transducer element of the transducer to stabilize following termination of the burst.

This delay time defines the closest distance that can be accomodated by the ultrasonic apparatus described herein. An echo signal returns to the transducer 2 and is applied to a preamplifier in the ultrasonic circuit board and is processed as described in U.S. Pat. No. 4,199,246 to produce an output signal on line c called the FLG signal or flag signal. An example of a flag signal is shown in FIG. 3. The time between the leading edge of the XLG signal and the leading edge of the FLG signal represents the round trip echo time from the transducer to the apex of the stock loop 3 of FIG. 1. (The XLG signal is not the actual signal transmitted by the transducer but it is the digital logic drive for the transmitted signal). All timing relationships between transmitted signals and received echos are determined from the leading edge of this XLG signal. The XLG signal is shown on line d of the ultrasonic circuit board 11. This signal, along with the FLG signal on line c, is amplified by line driver circuit within circuit board 11, 3 which will be subsequently described, and coupled to level shifter circuitry 18. Level shifter circuitry is provided to shift the level of the output signal from ultrasonic-circuitboard 11 to an acceptable level for the logic circuitry in the gating period and load logic circuit 21. Accordingly, the XLG and FLG signals on line c and d of level shifter 18 are coupled to the gating period and load logic circuit 21.

The VSW signal which initially starts the XLG signal is coupled to terminal e of the ultrasonic circuitboard from drive circuit 16 wherein it is originated and amplified. The VSW is also coupled to reset logic circuit 19. The leading edge of this VSW signal is used to generate a reset count signal in reset logic circuit 19. The reset count signal from logic circuit 19 is then coupled to (a) the binary counter 23 to clear the binary counter for the imminent arrival of the serial data and (b) an AND-gate circuit in Gating Period and Load Logic circuit 21.

Clock pulses from clock 22 are coupled through gating period load logic circuit 21 along the line labelled "serial data" to binary counter 23, which commences counting the number of clock pulses that are inputed to it. The leading edge of the FLG or echo signal on line c of level shifter 18 is used to stop the passage of clock pulses through circuit 21 and is therefore fed on line c to the gating period load logic circuit 21. The leading edge of the XLG signal is used to set the start of the gating period signal and is fed on line d to circuit 21.

At the end of the echo signal (FLG), a load data signal (LDS) is generated in latch logic 20 and coupled to data latch 24 on line LDS. This load data signal enables latch circuit 24 to latch the counted pulses in 12-bit binary counter 23 and couple this digital information to the input of D to A converter 25.

The D to A converter 25 converts the digital voltage information to an analog voltage signal proportional to the value of the digital signal. For example, if the digital signal input to the D to A converter is zero, the analog voltage out of the A to D converter would be zero volts, whereas if the digital signal input to the D to A converter 25 is a maximum of 12 bits (equal to $12^2$ or 4096 in decimal units) the analog voltage output at terminal C of the D to A converter would be minus 15 volts. This voltage at point C is summed with a reference voltage established at point D, which is established by the setting of potentiometer 13 and represents a voltage proportional to the distance setting desired in the loop. The resultant sum voltage is multiplied by the gain of output amplifier 27 and is applied to the speed control circuit. If the D to A output voltage is equal and opposite to the reference voltage setting at D, then the loop is satisfied.

The above description completes the disclosure of the block diagram embodiment of FIG. 2. The more detailed description of the elements within the blocks of diagram FIG. 2 will now be described in connection with FIG. 4 wherein the elements within dotted lines correspond to similarly numbered blocks in the block diagram of FIG. 2. Thus, for example, the elements within dotted line 18 in FIG. 4 correspond to the block labelled 18 entitled "Level Shifters" in FIG. 2.

Figure 4:
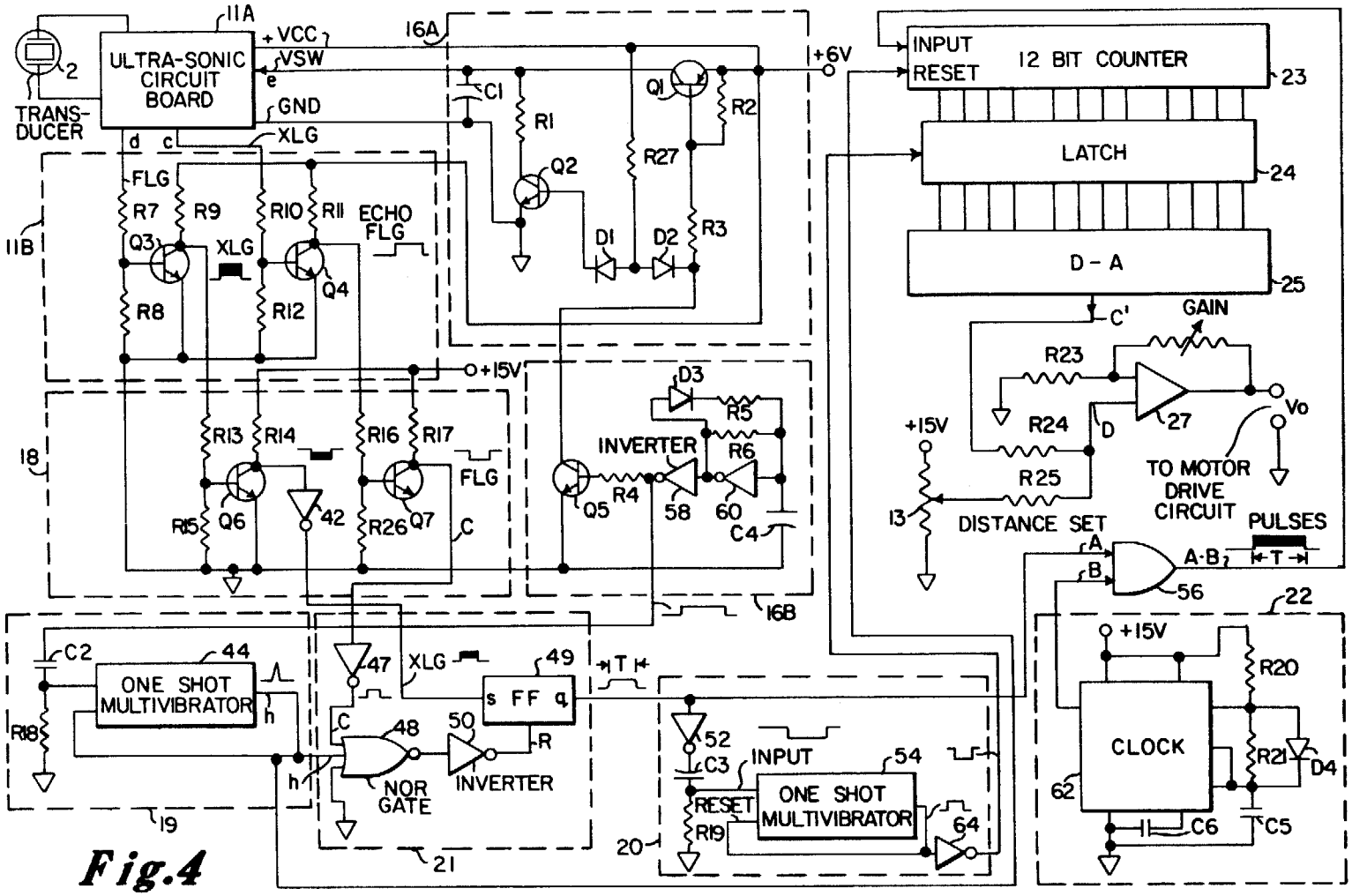
FIG. 4 is a detailed schematic of the apparatus of the invention.

Referring now to the upper left-hand portion of the drawing of FIG. 4, there is shown a transducer 2 which, as previously described, emits a signal to the stock loop and after emitting the ultrasonic signal is switched to a receive mode wherein echo signals bounced off the stock loop are received by transducer 2 and coupled to the ultrasonic circuitboard 11A. Two signals are supplied from the ultrasonic circuitboard 11A, the echo flag signal on line c, and the XLG signal on line d, both of which were previously described.

In operation, the system is energized by applying 6 volts DC from a power supply circuit, not shown. The 6 volts is applied to the ultrasonic circuitboard 11A along the line labelled +VCC. When the +6 volts is applied to the ultrasonic circuitboard 11A, simultaneously, 6 volts is applied to the drive circuit 16A and 15 volts to drive circuit 16B, and, in particular, oscillator 60 and inverter 58 of drive circuit 16B. When the voltage is supplied to oscillator 60 it begins to oscillate and as it does so, capacitor C4 charges up to a predetermined voltage through the feedback path from oscillator 60 through diode D3 and resistor R5 and parallel resistor R6.

When the voltage on C4 exceeds a predetermined threshhold voltage, the output of oscillator 60 goes low. At this point, the capacitor C4 discharges through resistor R6. At a certain level, C4 can no longer discharge through this path, because of the blocking diode D3. Thus, an asymmetrical waveform is established. This asymmetrical waveform voltage is inverted by inverter amplifier 58 to provide a positive going VSW voltage signal to one-shot multivibrator 44. When the output of inverter 58 goes high, it turns on Q5 pulling the base of Q1 0.6 V lower than the emitter of Q1, thus turning on Q1 and applying voltage to the VSW input of the ultrasonic circuitboard 11A. When the output of inverter 58 returns to its low state; transistor Q5 turns off thus turning off Q1, turning on Q2 to enable rapid discharge of capacitor C1. When VSW goes high, diode D2 becomes forward biased thus turning off Q2 allowing C1 to charge through transistor Q1.

The VSW signal from inverter amplifier 58 is coupled to capacitor C2 and reset logic circuit 19. This pulse triggers the one-shot multivibrator 44 sending a pulse on line h as one input to an OR gate formed by a NOR-gate 48 and inverter 50 within gating period load logic circuit 21. The same trigger signal on line h is also coupled to 12-bit counter 23 to reset the counter for an input data stream. In other words, the 12-bit counter is reset to all zeros by the reset signal from 1-shot multivibrator 44.

The other input to NOR-gate 48 is the FLG or echo signal from line c of level shifter 18. This FLG signal has been previously generated in the ultrasonic circuitboard 11A and amplified to a 15 volt level in amplifier Q4 and then further amplified and inserted in level shifters circuit 18 and inverter Q7, in particular. After amplification in level shifter 18, the FLG signal is coupled to an inverter 47 within gating period load logic circuit 21 wherein the signal is inverted to the correct polarity for the input to NOR-gate 48.

NOR-gate 48 in combination with inverter 50 form an OR-gate circuit, such that if a positive or high signal is present on line c or a positive or high signal is present on line h, a positive pulse is passed to the reset terminal R of flip-flop 49. Thus, the reset signal from inverter 50 is coupled on line R to the flip-flop 49. When a signal is present on this line it resets the flip-flop 49 or turns it off and sets it for the next time an input pulse comes on the input line labelled "S".

The line labelled "XLG" of flip-flop 49 introduces the XLG signal from level shifter 18. In level shifter 18 the XLG signal is amplified by amplifier Q6 and inverted in inverter 42 after having been passed through line driver Q3 of ultrasonic circuitboard 11B. When the leading edge of the XLG signal appears at flip-flop 49, flip-flop 49 starts conducting and generates a signal at output lead q commencing with the leading edge of the XLG signal at terminals. This signal is the gating period signal which is on for a time T commencing with the leading edge of the XLG signal and terminating with the leading edge of the echo or FLG signal. The gating period signal is inverted in inverter 52 and coupled through capacitor C3 through RC network C3 and R19 to the input of one-shot multivibrator 54. One-shot multivibrator 54 produces a positive going trigger signal in response to a positive going input signal at its input side. This positive going output signal is transmitted back to the reset terminal on the one-shot multivibrator to reset the multivibrator when the pulse from RC network $C_3$ and $R_{19}$ returns to zero volts.

The trigger signal from one-shot multivibrator 54 is inverted in inverter 64 and coupled to latch circuit 24. The data latch circuit 24 consists of three 4-bit data latches. The trigger signal from inverter 64 signals the latch circuits to accept the binary count from 12-bit counter 23 and "latch" or store them momentarily. This frees-up the 12-bit counter for the next input data stream.

Note, in the preceding description, the one-shot multivibrator 54 operates on the tail edge, not the leading edge of the gating period signal and therefore the inverter 52 inverts the positive going waveform so that the one-shot multivibrator operates off the positive going edge of the input signal. In other words, the latches are triggered at the end of the gating period so the data is retained during reset of the 12-bit counter for the next incoming data stream.

The gating signal from flip-flop 49 is also coupled to AND-gate 56. In addition to the signal from flip-flop 49, which is the A input to AND-gate 56, the clock pulse stream emitted by clock pulse generator 62 is coupled to the B side of AND-gate 56. Clock pulse generator 62 continuously emits a train of pulses at a frequency of 100 kHz. The output of the AND-gate 56 is therefore a train of pulses at a repetition rate of 100 kHz for a duration equal to the gating period. Thus, the number of pulses passed through AND-gate 56 during the gating period is proportional to the round-trip distance from the transducer to the stock loop and back.

This input data train is fed into a 12-bit counter 23. The binary count from the previous gating period is now in the data latch circuit 24. This binary count is converted to a DC voltage output at C' by D to A converter 25. This DC voltage is summed with a 15 volt reference voltage. This summation occurs at the D input to differential amplifier 27.

When the voltage at the wiper arm of the Distance Set potentiometer 13 is equal to the absolute output voltage of D to A counter 25 at point C', then the output of amplifier 27 is zero volts, and no voltage is passed to the motor drive circuit since at this point the distance of the loop to the transducer is at the correct setting.

If the distance is smaller than it should be, then the output of amplifier 27 goes positive and drives the loop motor to increase the loop distance until the output voltage goes to zero.

The foregoing circuit has been produced and utilized with excellent results. The value of the circuit components and a detailed description of some of the purchased parts used in this reduction to practice is shown on Table 1 below. It should be noted that these are representative circuit values and that the invention is not intended to be limited to these particular values.

TABLE I

| Circuit # | Value | Circuit # | Value |
|---|---|---|---|
| $R_1$ | 1,000 ohms | $C_1$ | 1 mircrofarad |
| $R_2$ | 12,000 ohms | $C_2$ | 150 picofarad |
| $R_3$ | 5,600 ohms | $C_3$ | 150 picofarad |
| $R_4$ | 10,000 ohms | $C_4$ | 2 microfarad |
| $R_5$ | 50,000 ohms | $C_5$ | .002 microfarad |
| $R_6$ | 50,000 ohms | $C_6$ | .01 microfarad |
| $R_7$ | 22,000 ohms | | |
| $R_8$ | 22,000 ohms | | Description/ |
| $R_9$ | 5,600 ohms | Circuit # | Manufacturer |
| $R_{10}$ | 22,000 ohms | $Q_1$ | 2N4403 |
| $R_{11}$ | 5,600 ohms | $Q_2$ | 2N4401 |
| $R_{12}$ | 22,000 ohms | $Q_3$ | 2N4401 |
| $R_{13}$ | 22,000 ohms | $Q_4$ | 2N4401 |
| $R_{14}$ | 5,600 ohms | $Q_5$ | 2N4401 |
| $R_{15}$ | 22,000 ohms | $Q_6$ | 2N4401 |
| $R_{16}$ | 22,000 ohms | 23 | Bit Counter - |
| $R_{17}$ | 5,600 ohms | | CD4040BE (RCA) |
| $R_{18}$ | 27,000 ohms | 24 | Latch - 3 - |
| $R_{19}$ | 27,000 ohms | | CD4072RE (RCA) |
| $R_{20}$ | 10,000 ohms | 25 | D-A AD7541JN |
| $R_{21}$ | 10,000 ohms | | (Analog Device) |
| $R_{22}$ | 500,000 ohms | 26 | 741 Operational Amplifier |
| $R_{23}$ | 10,000 ohms | 27 | 741 Operational |
| $R_{24}$ | 10,000 ohms | | Amplifier |
| $R_{25}$ | 10,000 ohms | 46 | Flip-Flop CD4043 BE (RCA) |
| $R_{26}$ | 22,000 ohms | | |
| $R_{27}$ | 38,000 ohms | 52 | Amplifier 74C14 (Motorola) |
| | | 54 | One-Shot Multivibrator CD4043BE (RCA) |
| | | 62 | Clock - ICM7555 (Intersil) |

This completes the description of the preferred embodiments of the invention. However, many modifications thereof will become apparent to those skilled in the art, after reviewing the above description. Accordingly, it is intended that this invention not be limited except as defined by the following claims.

What is claimed is:

1. A stock loop controller comprising:

(a) a transducer adapted to transmit an ultrasonic signal in the direction of a stock loop to be controlled;

(b) a start signal co-incident with the leading edge of the ultrasonic signal;

(c) a receiver circuit for detecting echo signals from the stock loop;

(d) a clock pulse generator for generating a fixed number of clock pulses per time interval;

(e) digital counter means for accumulating and counting the clock pulses commencing with the start signal and terminating with receipt of the echo signal and generating a digital signal proportional to the count;

(f) converter means for converting the digital signal to an analog signal; and (g) amplifier means coupled between said converter means and a reference voltage for generating a difference signal proportional to the difference between the analog signal and the reference signal; the difference signal being adapted to provide a control voltage to a servomotor controlling the stock loop.

2. The controller of claim 1 including a first potentiometer means for varying the gain of the amplifier thereby varying the sensitivity of the controller.

3. The controller of claim 2, including a second potentiometer, in series with the reference signal to provide a distance adjustment.

4. The controller of claim 1 wherein the transducer emits a burst of energy consisting of a plurality of pulses at a plurality of ultrasonic frequencies.

5. The controller of claim 1 including servomotor means controlled by said difference signal.

6. The method of controlling stock loop comprising:

(a) transmitting an ultrasonic signal in the direction of said loop;

(b) receiving an echo signal from said loop;

(c) counting pulses from a clock pulse generator at the time the ultrasonic signal is transmitted and stopping the count when the echo signal returns;

(d) generating a digital signal proportional to the number of clock pulses counted;

(e) converting said digital signal to an analog signal;

(f) amplifying the difference between said analog signal and a reference signal in an amplifier to produce a difference signal; and (g) using said difference signal to control the pay-out or take-up of said stock loop.

7. The method of claim 6 wherein the ultrasonic signal comprises a burst of energy at a plurality of frequencies.

8. The method of claim 6 wherein the gain of the amplifier may be varied to adjust the sensitivity of the control.

9. The method of claim 6 wherein the reference voltage may be varied to provide a distance adjustment for proper loop distance setting.

10. The method of claim 6 wherein latch means are provided for temporary storage of the digital signal.

* * * * *